United States Patent [19]

Lawrence

[11] 4,074,969

[45] Feb. 21, 1978

[54] PROCESS FOR RECOVERY AND REUSE OF AMMONIA IN A LIQUID AMMONIA FABRIC TREATING SYSTEM

[75] Inventor: Jackson Lawrence, Troy, N.Y.

[73] Assignee: Cluett, Peabody & Co., Inc., New York, N.Y.

[21] Appl. No.: 679,059

[22] Filed: Apr. 21, 1976

Related U.S. Application Data

[63] Continuation-in-part of Ser. No. 490,202, July 19, 1974, abandoned.

[51] Int. Cl.[2] ..... D06M 1/24; F25J 3/00

[52] U.S. Cl. ..... 8/125; 8/82; 8/149.1; 8/151; 62/115; 68/18 C

[58] Field of Search ..... 8/125, 82, 149.1; 68/18 C

[56] References Cited

U.S. PATENT DOCUMENTS

| | | | |
|---|---|---|---|
| 3,406,006 | 10/1968 | Lindberg et al. | 8/125 |
| 3,664,158 | 5/1972 | Skaathun et al. | 68/5 D |
| 3,721,097 | 3/1973 | Briley et al. | 62/113 |
| 3,876,370 | 4/1975 | Birke et al. | 8/174 |

*Primary Examiner*—John Kight, III

[57] ABSTRACT

The disclosure is directed to a system for the recovery of spent ammonia, in connection with the processing of fabrics and the like with liquid ammonia, and concerns particularly the elimination from the recovered ammonia of undesired water.

Economic processing of fabrics by liquid ammonia requires recovery and reuse of substantial quantities of ammonia. In the course of processing, the ammonia unavoidably becomes contaminated with water. Separation of water from ammonia on a laboratory level or, in any kind of batch processing is a theoretically simple matter and can be coped with by conventional differential evaporation techniques, or otherwise. However, in a continuously operating processing line where large quantities of anhydrous liquid ammonia are being used as the treating medium, water accumulates rapidly, not only from the fabric being processed, but also from a certain inevitable amount of air leakage in the system. Because so much of any given increment of the treating medium must be recycled, as compared to that actually "used up" in the treating process, water accumulates rapidly in the system and must be removed on a continuous basis. The specification discloses a unique and highly efficient procedure for removal of water by effecting condensation of water and ammonia vapors, constituting the process effluent, by feeding the effluent to a desuperheating vessel, where it is brought into direct contact with a body of low temperature liquid ammonia. This is done in conjunction with a preliminary low temperature condensation of the effluent in a non-contact heat exchange stage. The condensed body of liquid ammonia in the desuperheater vessel, including residual condensed water from the process effluent combined with re-liquefied ammonia, forms the feed supply of liquid ammonia solution to the process. The condensed water, which in the new process constitutes a portion of the feed supply, is applied to the fabric being treated, along with the liquid ammonia. Typically, some of the water is carried away with the processed fabric as a constituent of its moisture content. The remainder, which is driven off as steam in the process, is recycled.

A key factor in the new process is that the re-liquefied ammonia, instead of being sent directly back to the process, is directed into the desuperheater vessel, there being combined with the condensed process effluent. The combined solution, containing a minor fraction of condensed residual water is then fed back to the process. In this manner, the total water fraction in the process solution may be kept a satisfactorily low level, typically on the order of two or three percent maximum, under extreme process conditions, and desirably much lower than that under more favorable process conditions.

13 Claims, 2 Drawing Figures

PROCESS FOR RECOVERY AND REUSE OF AMMONIA IN A LIQUID AMMONIA FABRIC TREATING SYSTEM

RELATED PATENTS

This application is a continuation-in-part of my copending application Ser. No. 490,202, filed July 19, 1974, now abandoned.

This application also is related to and constitutes an improvement over the subject matter of the Briley et al U.S. Pat. No. 3,721,097, assigned to Cluett, Peabody & Co., Inc., the assignee of this invention.

BACKGROUND AND SUMMARY OF THE INVENTION

Fabrics constructed at least in part of cellulosic materials can be processed advantageously by exposure to liquid ammonia, to achieve improvement in shrinkage resistance and to provide greater affinity of the fabric to other process chemicals. In accordance with known liquid ammonia treating techniques, the fabric may be exposed briefly to liquid ammonia solution, as by immersion in a bath of the liquid. After a predetermined reaction time, advantageously less than about nine seconds, the fabric is heated, to vaporize and drive off the ammonia and terminate the reactions at a desired level.

In a typical liquid ammonia process, only a small percentage, (for example, about 5%) of the ammonia is actually consumed in the process reactions, or otherwise lost. The balance is in the form of ammonia vapor. Because of the potentially hazardous and unpleasant nature of ammonia vapors, and also for obvious economical reasons, it is important in a practical liquid ammonia processing operation to recover, for reliquefaction and reuse, the spent ammonia vapors. Broadly speaking, this can be accomplished by withdrawing the ammonia vapors from the fabric treatment chamber and compressing and condensing such vapors. The condensed vapors are returned to a liquid ammonia storage tank for eventual reuse in the system.

One advantageous system for the recovery and reuse of ammonia vapors is reflected in the aforementioned Briley et al U.S. Pat. No. 3,721,097. In the system of the Briley et al patent, the hot vapors from the processing chamber are directed to a desuperheating vessel, in which the vapors bubble through a bath of liquid ammonia, which may be at a temperature around −28° F. The desuperheated gases are then directed through appropriate compressing and condensing stages, and the resulting liquefied ammonia is returned to a storage tank for ultimate reuse in the process.

While the system of the Briley et al U.S. Pat. No. 3,721,097, constituted an important advance in the art of ammonia recovery, overall operating efficiencies are partially limited by gradual accumulation of water in the system. Because water is highly condensable in relation to the ammonia, it is difficult to separate from the liquid ammonia. That is, in a high speed continuous processing line, large quantities of treating medium in the form of anhydrous liquid ammonia are utilized and to a large extent must be continuously recycled. Because the system inherently will accumulate water, it must also be accommodated either on a batch basis requiring shutting down the line, or on a continuous basis. However, because the properties of ammonia and water are closely related their separation is difficult in the environment of a continuously operating processing line, as opposed to conventional laboratory separation procedures. These water accumulations have necessitated the extraction and discarding from the process of water-diluted liquid ammonia from time to time. Where circumstances permit, such extractions can be used in fertilizer applications. Otherwise, the material must be incinerated or otherwise properly disposed of.

In accordance with the present invention, a unique, highly simplified, yet wholly effective procedure is provided for continuously eliminating water accumulations from the liquid ammonia recovery system without requiring the destruction or low grade utilization of significant quantities of liquid ammonia. The procedure of the invention involves, in a liquid ammonia recovery system of the general type described in the Briley et al patent, the unique procedure of deriving the liquid ammonia make-up flow to the treatment chamber from the retained liquid body in the desuperheating vessel which receives the spent process vapors including the residual water fraction in the first place. In a continuously operating process, this continuous outflow of condensed water in the make-up liquid prevents significant accumulations of water in the desuperheating vessel and maintains the percentage of water at a level of, for example, 2–3% under the most extreme process conditions and much less under more favorable conditions. At those levels the water constitutes a relatively insignificant impurity.

In conjunction with the foregoing, the fabric treatment process ideally is carried out in such a manner that, when the fabric is heated after contact with the liquid ammonia, to terminate the ammonia reactions, the ammonia is vaporized, but the water content of the fabric substantially remains. Thus, fabric emerging from the treatment chamber carries with it an increment of additional moisture, which is thus permanently removed from the ammonia recovery system.

In some commercial applications of the process, it is not always practicable to control the process so as to avoid distilling off significant percentages of the residual moisture content of the fabric. In such cases, the gaseous process effluent may carry excessively high percentages of moisture. Pursuant to another specific aspect of the invention, such a gaseous process effluent, prior to being discharged into direct heat exchange contact with liquid ammonia in the desuperheating vessel, is prechilled by non-contact heat exchange, desirably utilizing liquid ammonia as the heat exchange medium. With a heat exchange unit of practical proportions, this can serve to precondense residual moisture out of the gaseous effluent down to the two or three percent level.

Regardless of the procedure utilized to extract excess water from the continuous process system, whether by mechanically conveying it out with the fabric and/or by condensing a portion of it and/or by utilizing some other technique, such as desiccants, no practical technique for water removal will be 100% effective. Such being the case, with conventional procedures, water will gradually accumulate in the desuperheater vessel, either rapidly or slowly depending on the efficiency of the water extraction techniques, to the point where the desuperheating vessel will be operating at greatly reduced efficiency. However, pursuant to the invention, the liquid content of the desuperheater vessel, including condensed residual water, is continually fed back to the process chamber, and recycled through the various water removal stages. The re-liquefied ammonia from the recovery system, instead of being fed directly back to the processing chamber from its storage vessel, is fed to the desuperheating vessel as makeup for the extracted water-containing solution. Accordingly, the water content of the desuperheater vessel is easily maintained at an adequately low level on a steady-state basis.

A secondary, but nevertheless significant, advantage of feeding re-liquefied ammonia to the desuperheating vessel is that it is thereby simultaneously pre-chilled to its operating temperature of −28° F. (−33° C) at a convenient location upstream of the processing chamber without requiring a separate procedure for that purpose. As compared to feeding the re-liquefied ammonia directly to the processing chamber where the elevated temperature must be accommodated, the pre-chilling significantly reduces the energy requirements of the system. Thus, the procedure of the invention not only effectively eliminates accumulating water on a continuous, steady-state basis, but simultaneously achieves significant efficiency improvements in the ammonia recovery system.

For a better understanding of the above and other features and advantages, reference should be made to the following detailed description and to the accompanying drawings.

DESCRIPTION OF A PREFERRED EMBODIMENT OF THE INVENTION

Figure 1:
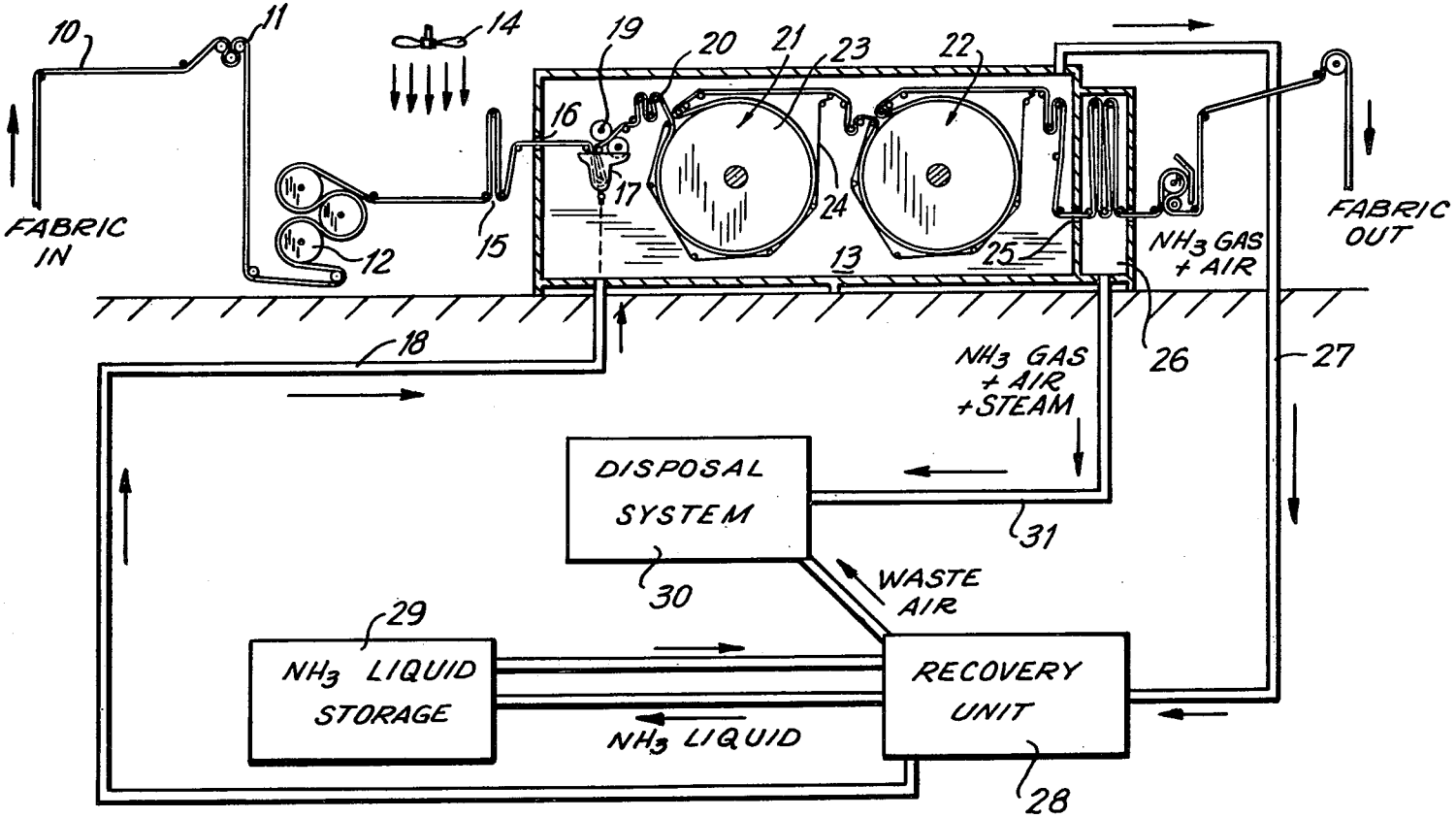
FIG. 1 is a simplified schematic representation of a typical form of liquid ammonia fabric processing system, incorporating an ammonia recovery system in accordance with the invention.

Referring now to the drawings, and initially to FIG. 1 thereof, there is shown schematically an advantageous system for carrying out a liquid ammonia treatment of a fabric or yarn, for example. For purposes of this description, it will be assumed that the material being processed is a fabric web, comprised substantially of cellulosic materials. However, apart from the ability of the treated material to optimize process efficiencies by receiving and carrying away small quantities of water, the specific nature of the material being treated is not significant to the present invention.

In FIG. 1, a fabric web 10, from a suitable supply (not shown) passes over tension control rollers 11 and is then directed about one or more heated rollers 12, constituting a pre-drying section. Passing over the series of pre-drying rollers 12, the fabric is heated sufficiently to drive off excess moisture. In this respect, incoming fabric typically may contain as much as 7–10% (by weight of the fabric) of moisture. The amount of moisture in the fabric may unduly inhibit the desired reactions of the liquid ammonia process, which normally should be carried out in a liquid ammonia solution containing not more than about 10% water. Although the weight of ammonia in relation to the weight of fabric during reaction phase may vary widely, a relationship of one-to-one (e.g., one part by weight of the ammonia solution to one part by weight of fabric) is not untypical. In such cases, if the incoming fabric carries as much as 10% water, that amount of water will be present at the reaction site, and will constitute approximately 10% of the ammonia solution. This is an undesirably high level, particularly where the ammonia solution itself may contain some water, as contemplated in the present invention. Accordingly, the pre-drying stage typically is controlled to drive off enough moisture from the fabric to leave a residual moisture content on the order of 3–5% by weight of the fabric. Of course, if the incoming fabric is sufficiently dry to begin with, the pre-drying stage may be omitted.

Fabric leaving the pre-drying stage will be at an undesirably elevated temperature and is thus cooled prior to entering the liquid ammonia treatment chamber 13. Typically, suitable fan or blower means 14 is disposed downstream of the pre-drying section, to direct streams of cooling air on the fabric and return it to near ambient temperature levels.

The pre-dried and cooled fabric, after passing over additional tension control rollers 15, enters the treatment chamber 13 through a sealed opening 16. An advantageous form of seal for such opening is described and claimed in the copending application Ser. No. 490,199, of Jackson Lawrence, filed July 19, 1974 for "Low Friction Pressure Seal For Fabric Processing Chamber". Typically, the interior of the chamber is maintained at a slightly negative pressure, relative to ambient, and the entrance opening 16 is provided with a double seal. An intermediate chamber, between the double seals, is maintained at a slightly more negative pressure than the interior of the chamber, so that inevitable slight leakage of the seals will tend to be directed into the intermediate chamber. This minimizes leakage of ammonia vapors from the treatment chamber into the atmosphere. In a typical process, the main treatment chamber may be operated at a negative pressure of about 0.5 inches $H_2O$ while the intermediate chamber may be kept at a negative pressure of about 0.75 inches $H_2O$.

In the simplified arrangement illustrated in FIG.1, a processing trough 17 is provided in the treatment chamber 13. This trough, through appropriate controls (not shown, and forming no part of the invention) is supplied with liquid ammonia processing solution through an infeed line 18. The controls of this may include a float valve (not shown), for maintaining the processing liquid at an appropriate level in the trough.

After entering the processing chamber, the fabric is guided into the trough 17 and thus immersed in the liquid ammonia solution which is at a temperature of about −28° F. It is then directed through padding rollers 19, for extraction of excess processing solution, then about a series of adjustable timing rollers 20. After a predetermined reaction time, the fabric is brought into contact with a source of heat, which flashes off the liquid ammonia. In the illustrated system, a pair of Palmer-type dryer units 21, 22 are provided. These include large heated drums 23 about which a confining blanket 24 is trained. For practical purposes, the ammonia reactions are substantially diminished soon after the initial contact between the fabric and the first dryer drum. To advantage, the time interval between initial immersion in the liquid ammonia and the initial contact with the first dryer drum is controlled to be within the range of 0.6 seconds to 9 seconds. This can be effectively controlled by regulation of the length of travel between the trough 17 and the first dryer unit 21, as by adjustment of the rollers 20 to lengthen or shorten the path of the web, as may be appropriate. However, except as relates to the control of water in the fabric and in the processing solution and as relates to the control of the operation of the dryer units 21, 22, specific process conditions do not form a part of this invention.

After leaving the second dryer stage 22, the fabric leaves the main treatment chamber 13 through a discharge opening 25. This opening, like the entrance opening 16, advantageously is provided with a double seal with an intermediate chamber maintained at a slightly more negative pressure than the treatment chamber itself.

Fabric leaving the main treatment chamber 13, advantageously may be directed through a steam chamber 26, after which the fabric may be conveyed away to a folder or batcher, for example.

In the processing of fabric in the main treatment chamber 13, only about 5% of the liquid ammonia supplied to the trough 15 is actually consumed. The remainder is flashed off as ammonia vapor. These vapors are not only potentially hazardous, but the re-use thereof is economically important in a continuous commercial process. Heretofore, recovery of the ammonia vapors has been carried out by withdrawing vapors from the treatment chamber, and compressing and condensing the vapors. Considerable amounts of air are normally contained in the withdrawn gases, but air is easily separated from the ammonia because of the relative noncondensability of air. The withdrawn gases also include quantities of water, which continually enter the process because of the basic moisture content of the fabric and also of the incoming air which, notwithstanding the efficiencies of the entrance and exit seals, is present in certain amounts in the interstices of the fabric and enters with fabric. Such amounts of water have, in the past, proven difficult to remove as noted above, necessitating occasional discarding of quantities of the diluted liquid ammonia, or its use as a low grade material such as in fertilizer applications. The process of the present invention is directed to the recovery of the spent ammonia in a manner that enables the water to be easily and effectively removed on a continuous basis, so that the process reactions are not inhibited by excessive water in solution with the otherwise relatively pure anhydrous liquid ammonia, and so that maximum utilization of the liquid ammonia in the processing operation may be realized.

In the simplified schematic representation of FIG. 1, a suction line 27 leads from the main treatment chamber 13 for effecting continual withdrawal of gases from the interior of the chamber. These gases are directed initially to a recovery section, generally designated by the numeral 28 in FIG. 1, in which the gases are processed to compress and condense the liquid ammonia and to separate air. A liquid ammonia storage vessel 29 is provided for temporary containment of the recovered liquid ammonia. As will be described in greater detail with respect to FIG. 2, the infeed line 18, through which the processing trough 17 is supplied, is not directly connected with the storage vessel 29, but rather leads from the recovery section 28. The stored liquid ammonia is first directed from the vessel 29 back into the recovery system, where it is utilized in a manner to be described, and then is directed to the processing trough 17 along with an increment of water extracted from the recovered gases.

In accordance with conventional practice, air separated from the recovery system is directed to an incinerator or other disposal facility 30. Likewise, the mixture of air and steam from the steam chamber 26, containing some residual ammonia gas, is directed through a suction line 31 to the disposal facility. Because of the relatively small amounts of ammonia in these gases, it is considered uneconomical to attempt to recover it.

Figure 2:
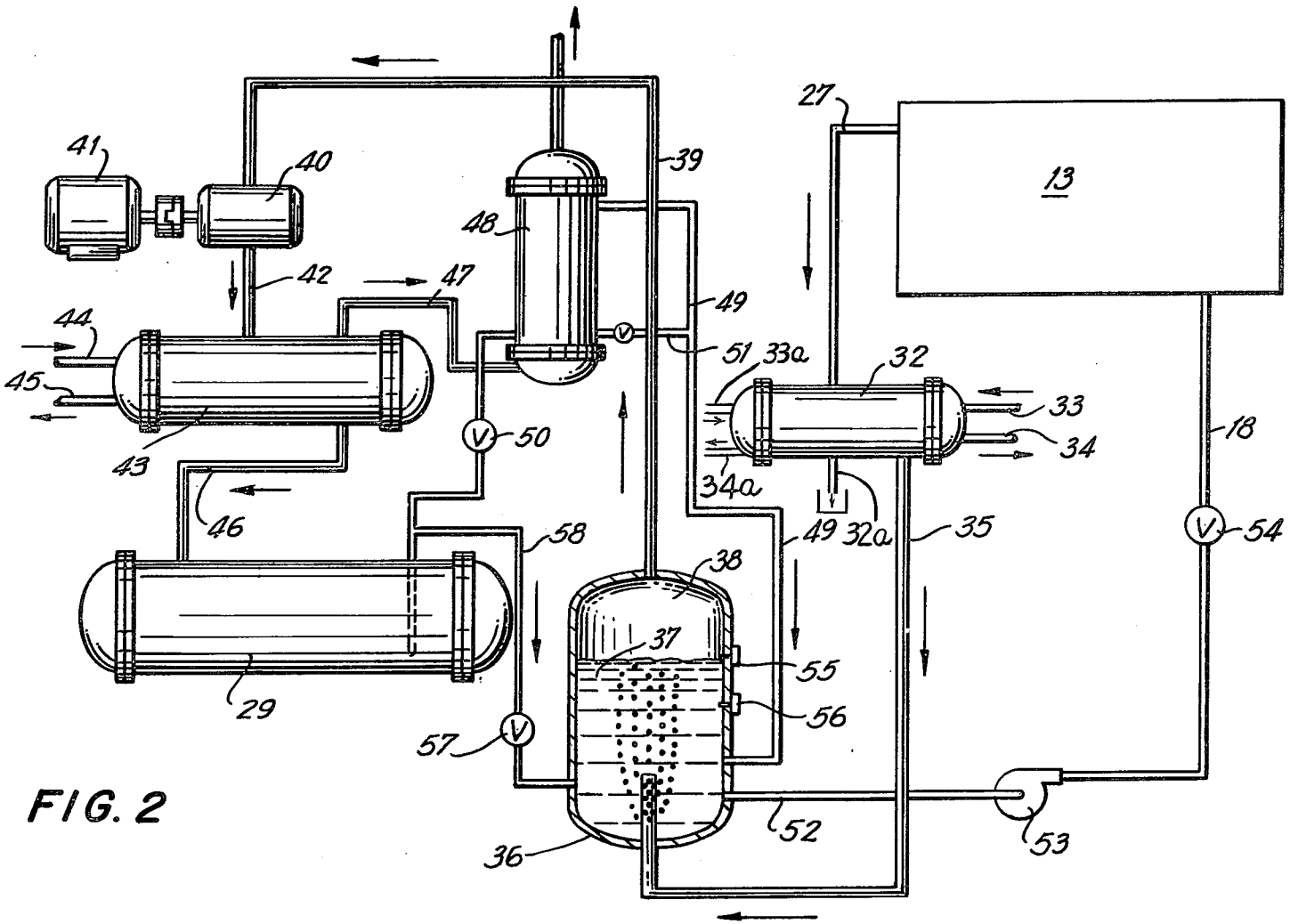
FIG. 2 is a simplified schematic representation of principal components of an ammonia recovery liquefaction system according to the invention.

Referring now to the schematic diagram of FIG. 2, the suction line 27 is shown to lead from the treatment chamber 13 to a non-contact heat exchanger 32 which may be of a shell and tube type. The withdrawn gases, comprising predominantly ammonia gas, but also containing quantities of air and water vapor, may be passed through the shell side of the exchanger, while cooling medium is flowed in the tube side of the exchanger.

To advantage, the non-contact heat exchanger 32 has two heat exchanger stages constituting cooling and chilling stages. In the cooling stage, water may be utilized as the heat exchange medium, being flowed through lines 33, 34. In this stage, gases leaving the treatment chamber 13 at a temperature of, typically, about 150° F., are pre-cooled in the water section of the exchanger to about 90° F. In the second stage of the heat exchanger, liquid ammonia desirably is utilized as the non-contact heat exchange medium. The liquid ammonia is supplied through lines 33*a*, 34*a*, being supplied at a temperature of around −28° F. and serving to chill the effluent process gases from the pre-cooled temperature of 90° to, say, about −21° F.

Pursuant to one aspect of the invention, the low temperature chilling of the effluent gases in the second stage of the heat exchanger 32 serves to condense out of the gas a substantial fraction of the residual moisture content. This condensed water fraction can be drained off at 32*a* and collected for further processing or low grade utilization.

Because of the extremely high affinity of ammonia for water, the water fraction condensed in the heat exchanger 32 will inevitably absorb some ammonia, so that the condensate extracted at 32*a* typically is around a fifty percent mixture of water and ammonia. The overall amounts of collected condensate are generally quite small. Thus, in a typical commercial process handling, say, 3000 pounds of fabric per hour and thus requiring a process feed of liquid ammonia solution of around 2500 to 3000 pounds per hour, the outtake of condensate may be on the order of 8 to 10 gallons per hour, approximately half of which is ammonia. Insofar as the outtake quantity of ammonia at this stage may become economically significant in a process of sufficiently high overall volume, at least some of the ammonia content of the condensate could be recovered without great difficulty.

The chilled gases from the heat exchanger 32, are directed into a desuperheating vessel 36 containing a body 37 of liquid ammonia. In the process of the invention, the desuperheating vessel is maintained at a slightly negative pressure, and thus the body 37 of liquid ammonia therein is maintained at a temperature on the order of −28° F., (or slightly higher, depending primarily on the total water fraction). The incoming process gases can be discharged directly into the lower portion of the desuperheating vessel 36 and bubbled upward through the cold liquid ammonia. Alternatively, the process gases may be sprayed with liquid ammonia. In either case, the direct contact heat exchange serves to remove superheat from the ammonia gases, with the cooled gases accumulating in the upper portion 38 of the vessel, along with additional gases which are flashed off from the liquid itself, in order to maintain its low temperature and liquid phase.

A suction line 39 connects the upper portion of the desuperheating vessel 36 with the suction side of a compressor 40, driven by a motor 41. In the compressor, the gases comprising principally desuperheated ammonia gas together with air, may be compressed to a pressure of, for example, about 180 psig. The compressed gases are heated substantially by the compression and leave the compressor through a high pressure line 42, at a temperature of about 100° F. The high pressure line 42 leads to the shell side of a shell and tube condenser-heat exchanger 43, cooled by water supplied to the tube side by inlet and outlet lines 44, 45.

Liquid ammonia condensate from the condenser 43, now at a temperature of about 95° F., is flowed through a high pressure line 46 into the storage and retention vessel 29. Uncondensed vapors from the condenser-heat exchanger 43, are taken off through a line 47 and directed into a purging vessel 48, in which the uncondensed vapors are flowed in non-contact heat exchange relationship with liquid ammonia at low temperature (typically −28° F.) and caused to condense. The condensed material from the purge vessel 48, is flowed through a line 49 into the desuperheating vessel 36, where the liquid fraction of such material adds to the body of liquid ammonia, and the contained gaseous fraction, if any, is bubbled through the liquid ammonia and recycled.

Liquid ammonia for cooling the purge vessel 48 is drawn from the retention vessel 29, passed through a suitable expansion valve 50 and directed into the tube side of the purge vessel, which typically is a shell and tube type heat exchange vessel. After passing through the tube side of the purge vessel 48, the liquid ammonia may be directed through an outlet line 51 and combined with the condensate flowing in the line 49, to the desuperheating vessel.

In accordance with a significant aspect of the invention, the liquid ammonia requirements of the process are supplied to the main treatment chamber 13, entirely or in substantial part through a line 18 which leads, not directly from the storage vessel 29, but rather from the desuperheating vessel 36 which received the effluent in the first place. To this end, the vessel 36 has an outlet line 52, leading to the intake side of a suitable pump 53 which discharges through a control valve means 54 into the line 18, connected to the processing trough 17. To advantage, the desuperheating vessel 36 may be provided with appropriate liquid level sensing elements 55, 56, establishing upper and lower limits for the level of liquid ammonia therein. A valve 57, in a liquid ammonia supply line 58 from the high pressure supply vessel 29, may be controlled by the sensors 55, 56, to admit ammonia into the desuperheater vessel, as necessary, to maintain the desired level therein.

As will be understood, the fresh, relatively pure anhydrous liquid ammonia admitted into the desuperheating vessel 36 from the storage vessel 29 performs several functions. First, the liquid may be directed to the desuperheating vessel 36 while still at a relatively high temperature of around 95° F., for example, and at a relatively high pressure of around 180 psig. Since the liquid body within the desuperheating vessel is in equilibrium at a slightly negative pressure and at a temperature of around −28° F., a certain amount of the incoming, fresh liquid ammonia is initially flashed off to provide self-cooling to the equilibrium conditions. In a typical process, as much as 25% by weight of the liquid ammonia from the storage vessel is flashed off as gas in order to effect self-cooling to −28° F. of the remaining 75%.

Significant advantages are realized, in the process of the invention, by effecting self-cooling of the re-liquefied ammonia at the desuperheater stage, rather than in the treatment chamber 13, as would be the case if the re-liquefied ammonia were taken directly from the storage vessel 29 to the treatment chamber. As will be appreciated, large volumes of ammonia are required for the self-cooling action and, where such volumes are released within the treatment chamber 13, as in the past, this serves to increase the energy requirements of the heating section of the processing chamber and correspondingly to increase the cooling requirements of the ammonia recovery system.

In the operation of the system of FIG. 2, liquid ammonia, containing a minor fraction of water, is directed through the lines 52, 18 into the processing chamber 13, and is supplied directly to the trough 17. The fabric web 10 is continuously advanced into and through the processing chamber at a predetermined speed. As the fabric enters the chamber, it is immersed in the trough 17 and becomes saturated with the liqud ammonia solution. When the processing equipment is in a steady-state condition, the chamber 13 is fully saturated with ammonia vapors so that, when the fabric emerges from the trough 17 and travels to the point of its initial contact with the dryer unit 21, it remains effectively saturated with the liquid ammonia. During this interval, the principal desired reactions between the ammonia and the fabric occur. Soon after the fabric is flashed off to substantially terminate the reaction, and the balance is substantially removed as the fabric travels over the dryer units 21, 22.

Although the relationship of fabric processed to ammonia solution utilized may vary widely with different fabrics, a relationship of one pound liquid ammonia infeed to one pound of fabric infeed in not untypical and will be assumed for the purposes of illustration herein. Thus, for each pound of fabric entering the chamber, a pound of the liquid ammonia solution is absorbed from the trough 17 and carried away with the moving fabric, with approximately 95% of that amount being flashed by the dryer units 21, 22. Thus, for each pound of fabric processed, nearly a pound of spent gases must be withdrawn from the chamber 13.

Because the incoming fabric conveys trapped air within its interstices, and because that air inherently will contain some moisture, the atmosphere within the chamber 13 necessarily will become partly diluted with air and its moisture. This will occur regardless of the efficacy of the seals at the entrance and exit openings. When this ammonia-rich mixture of gases is withdrawn from the chamber and bubbled through the desuperheating vessel 36, the moisture fraction in the gases readily condenses in the body 37 of liquid ammonia, which is at approximately −28° F. In addition, for some processing operations, an additional moisture fraction may be driven off of the fabric by heat of the dryers 21, 22. Unless properly dealt with, these water fractions will accumulate in the vessel 36, causing the temperature in the bath 37 to progressively rise until it is no longer serving its intended function, and must be extracted and discarded and/or used in a low grade application. In accordance with the invention, however, the water-containing liquid ammonia in the desuperheating vessel 36, is constantly extracted through the line 52 and utilized as the make-up feed to the impregnating trough 17.

As an integral part of the process of the invention, provision is made for the constant removal of water from the process, on a convenient and economical basis. Although the particular technique utilized for water extraction is not critical to the basic process of the invention, it is of course critical that some means be provided for water removal. To greatest advantage, and as one of the specific aspects of the invention, water is most conveniently removed by a combination of techniques, including mechanically conveying a water fraction out with the processed fabrics, where practicable and condensing a water fraction out of the hot effluent gases extracted from the treatment chamber. Thus, where processing conditions permit, it advantageous to so control the time-temperature relationships of the heating section as to drive off primarily the ammonia fraction while substantially retaining the water fraction in the fabric. By this means, the fabric can be caused to leave the process with a slightly greater moisture content than when it enters, resulting in a net outtake of water from the processing system.

Since not all fabrics and not all processing conditions admit of optimum control of the heating sections, secondary provision is made for pre-cooling and then chilling the hot effluent gases from the process, in order to condense out at least part of the water fraction in the spent gases. By pre-chilling the spent gases down to about −21° F., for example, which is readily accomplished in a non-contact heat exchanger of practical proportions, using available liquid ammonia as the chilling agent, the water fraction may easily be reduced down to 2–3%. By thus providing for alternative water removal by fabric conveyance or by condensation from the hot effluent gas, optimum process efficiencies may be realized. Where the nature of the fabric and the particular processing admits, the heating stage may be controlled to achieve a net outflow of water on the fabric itself. However, where the process cannot be operated in this ideal manner, the resulting high moisture content of the hot effluent gases will be significantly reduced by chilling in the non-contact heat exchanger 32.

The system of the invention is uniquely effective in eliminating the build-up of undesired quantites of water in the system and, at the same time, significantly improving the thermodynamic efficiency of the system, by drawing upon the booy of water-containing liquid ammonia solution in the desuperheating vessel for the supply of process solution. By feeding this solution back into the process, the water fraction, which is inherently going to the present in the recovered process gases, is prevented from accumulating to an undesired level and can be removed at a convenient stage of the process.

Under ideal conditions of process operation, the steadystate residual water content in the desuperheater vessel may be maintained at extremely low level. Even under adverse conditions, the water content of the desuperheating vessel may be easily kept at levels (2–3% or less) which enables both the primary treating process itself, and also the recovery system, to be operated at highly efficient levels.

One of the significant additional advantages of the unique process is the improved thermodynamic efficiency which results from feeding the re-liquefied ammonia into the desuperheating vessel, rather than directly into the process chamber 13. Thus, the re-liquefied ammonia in the storage vessel 29 is both at high pressure and at a relatively elevated temperature. At the time of use, the liquid ammonia must be brought to equilibrium at substantially atmospheric pressure (actually slightly below atmospheric) and at an equilibrium temperature of about −28° F. In order to achieve this equilibrium state, substantial percentages of the re-liquefied ammonia are flashed off as gas. When this is caused to occur at the desuperheating vessel, these substantial quantities of flashed-off gases are simply recycled through the recovery system, compressed and re-liquefied. If, on the other hand, the gases are flashed off in the treatment chamber 13, as according to prior practice, the flashed-off gases are returned to the recovery system only after being exposed to substantial heat within the treatment chamber. As will be appreciated, the heat which goes into elevating the temperature of that fraction of gas which is flashed off merely to bring the liquid ammonia to an equilibrium condition represents a waste of heat energy in the heating section of the process. Likewise, in order to re-liquefy and recover this gas, the heat must be removed therefrom, which serves to increase the working load on the compressor. Thus, in the new process, by deriving the process feed from the desuperheating vessel, and utilizing the re-liquefied ammonia as make-up feed to the vessel and not directly to the process chamber, not only is the water content of the system stabilized at an appropriate equilibrium level, but significant energy efficiencies are realized.

The system of the invention is uniquely effective in eliminating undesired water from the recirculating ammonia system. This is of critical importance, in a practical, commercial system, because there is almost a 20-to-1 ratio between the amounts of ammonia recycled and the amount basically consumed in the process, such that effective reclaiming techniques are vital. Heretofore, such reclaiming techniques have been severely limited by the practical difficulties in ridding the system of water which unavoidably enters the system.

The process and system of the present invention, operate on the basis of condensing out of the water fraction at an early stage in the recovery process, by direct contact with a body of cold liquid ammonia, with or without a prior non-contact condensation stage, to provide the make-up supply to the process. The condensed water in the desuperheating vessel is thus fed directly back into the process as quickly as it enters, enabling steadystate level to be reached which, experiece has shown, is sufficiently low as to have insignificant effects upon the process reactions. Thus, while as much as 10% moisture in the liquid ammonia solution may substantially inhibit the desired reactions, the water fraction introduced into the processing solution by the system of the invention, represents a relatively insignificant increment. In any case, provision may be made for predrying the incoming fabric, not only to minimize incoming moisture content, but also, under some conditions, enabling a water fraction to be removed by the fabric. Thus, in an ideal process, fabric may enter the process with a moisture content on the order of 5%, be subjected to the desired liquid ammonia reactions, and leave the process with a moisture content on the order, for example, 5.1%. By this means, the fabric itself serves as a continuous means of extracting water from the ammonia recovery system, permitting the system to operate on an extremely efficient basis, with a minimum wastage or low grade utilization of the recovered material. Where such ideal conditions are not realizeable, other means, such as non-contact condensation of spent gases are utilized to extract a water fraction.

It should be understood, of course, that the form of the invention herein illustrated and described is intended to be representative only, as certain changes may be made therein without departing from the clear teachings of the disclosure. Accordingly, reference should be made to the following appended claims in determining the full scope of the invention.

I claim:

1. In a continuous process for recycling gaseous effluents, comprised principally of gaseous ammonia, air, and water vapor, derived from the continuous treatment, with substantially anhydrous liquid ammonia, of a moving cellulosic-containing web of material, and wherein the moving web is continuously exposed in a confined treatment zone to said liquid ammonia at near-atmospheric pressure, and said web is thereafter heated in said zone to vaporize and remove said liquid ammonia from said web, the improvement characterized by (a) continuously withdrawing said gaseous effluent from said zone, (b) continuously removing a portion but less than all of the water vapor fraction from said gaseous treating zone effluent, (c) continuously introducing said withdrawn gaseous effluent into a body of substantially anhydrous liquid ammonia maintained at about atmospheric pressure to cool said gaseous ammonia and to condense water vapor from said gaseous ammonia, (d) thereafter compressing and condensing the gaseous ammonia, (e) continuously withdrawing substantially anhydrous liquid ammonia, together with condensed water, from said body and supplying the withdrawn liquid to said treatment zone for said exposing step, and (f) continuously replenishing said body of substantially anhydrous liquid ammonia with anhydrous liquid ammonia from said compressing and condensing step.

2. The process of claim 1, further characterized by (a) said water vapor removing step being carried out by continuously condensing out a portion of said process effluent prior to the step of introducing said effluent into said body of substantially anhydrous ammonia.

3. The process of claim 1, further characterized by (a) a portion of the water contained in the substantially anhydrous liquid ammonia furnished to said treatment zone being carried out of the zone by said web.

4. The process of claim 3, further characterized by (a) the additional step of pre-drying said web prior to its entry into said treatment zone.

5. The process of claim 2, further characterized by (a) said water removal step being carried out by non-contact heat exchange with liquid ammonia.

6. The process of claim 5, further characterized by (a) the additional step of cooling said effluent by non-contact heat exchange with water prior to said condensing step.

7. In a continuous process for recycling the effluent, comprised principally of gaseous ammonia, air, and water vapor derived from continuously treating a moving web of material with substantially anhydrous liquid ammonia in a treatment zone, wherein the treatment comprises continuously exposing said web in said zone to said substantially anhydrous liquid ammonia, immediately thereafter, heating said web in said zone to vaporize and remove said liquid ammonia from said web, the improvement characterized by (a) continuously withdrawing said effluent from said zone, (b) continuously pre-condensing out a portion of said effluent by non-contact heat exchange with liquid ammonia, (c) the pre-condensing step continuously removing a portion of condensed water vapor and ammonia from said process, (d) continuously introducing the remainder of said effluent not removed from said precondensing step into a first body of chilled substantially anhydrous liquid ammonia maintained at atmospheric pressure, to chill said gaseous ammonia and condense remaining water vapor, (e) the heat from said introducing step generating an additional ammonia gas fraction, (f) compressing and condensing the ammonia gas, including said fraction, to provide a retained second body of liquid ammonia at super-atmospheric pressure, (g) continuously withdrawing substantially anhydrous liquid ammonia together with condensed water from said first body and supplying the withdrawn liquid to said treatment zone for said exposing step, and (h) continuously replenishing said first body of substantially anhydrous liquid ammonia from said retained second body.

8. The process of claim 7, further characterized by (a) the additional step of continuously removing water from said treatment zone by said continuously moving web.

9. The process of claim 8, further characterized by (a) the additional step of continuously predrying said continuously moving web prior to entry into such treatment zone.

10. The process of claim 7, further characterized by (a) the water content of said first body being continuously maintained at a level of between about 2 and 3% or less.

11. The process of claim 7, further characterized by (a) said pre-condensing step cooling the remainder of said effluent to about −21° F. prior to introduction into said first body.

12. In a continuous process for recycling the effluent, comprised principally of gaseous ammonia, air, and water vapor derived from continuously treating a moving web of material with substantially anhydrous liquid ammonia in a treatment zone, wherein the treatment comprises continuously exposing said web in said zone to said substantially anhydrous liquid ammonia, immediately thereafter, heating said web in said zone to vaporize and remove said liquid ammonia from said web, the improvement characterized by (a) continuously withdrawing said effluent from said zone, (b) continuously introducing said effluent into a first body of chilled substantially anhydrous liquid amonia maintained at atmospheric pressure, to chill said gaseous ammonia and condense retained water vapor, (c) the heat from said introducing step generating an additional ammonia gas fraction, (d) compressing and condensing the ammonia gas, including the above mentioned gaseous fraction and the further gaseous fraction referred to in subparagraph (g) hereof, to provide a retained second body of liquid ammonia at superatmospheric pressure and at a temperature above the equilibrium temperature of liquid ammonia at near-atmospheric pressure, (e) continuously withdrawing substantially anhydrous liquid ammonia together with a condensed water fraction from said first body and supplying the withdrawn liquid to said treatment zone for said exposing step, and (f) continuously replenishing said first body of substantially anhydrous liquid ammonia from said retained second body, (g) said replenishing step generating a further gaseous ammonia fraction while cooling the newly added liquid ammonia to the equilibrium temperature of said first body.

13. The process of claim 12, further characterized by (a) the additional step of continuously removing water from said treatment zone by said continuously moving web.

* * * * *